US005157793A

United States Patent [19]

Michels

[11] Patent Number: 5,157,793

[45] Date of Patent: Oct. 27, 1992

[54] ERGONOMICALLY ENGINEERED UNDERWEAR

[76] Inventor: Cindy Michels, 103 Pine View Cir., Altamont Springs, Fla. 32714

[21] Appl. No.: 765,895

[22] Filed: Sep. 26, 1991

[51] Int. Cl.[5] ..... A41B 9/02

[52] U.S. Cl. ..... 2/403; 2/401

[58] Field of Search ..... 2/400, 401, 403, 406

[56] References Cited

U.S. PATENT DOCUMENTS

| | | | |
|---|---|---|---|
| 2,114,268 | 4/1938 | McDonald | 2/401 |
| 2,534,024 | 12/1950 | Hochbaum | 2/406 |
| 3,019,446 | 2/1962 | Wyss | 2/401 |
| 3,499,442 | 3/1970 | Steinmetz | 2/403 |
| 3,517,666 | 6/1970 | Atlee | 2/403 |
| 4,355,425 | 10/1982 | Jones | 2/403 |
| 4,875,236 | 10/1989 | Boynton | 2/403 |
| 4,972,525 | 11/1990 | Hwang | 2/403 |

FOREIGN PATENT DOCUMENTS

| | | | |
|---|---|---|---|
| 2215906 | 8/1974 | France | 2/403 |
| 1604558 | 12/1981 | United Kingdom | 2/403 |

*Primary Examiner*—Werner H. Schroeder
*Assistant Examiner*—Diana L. Biefeld
*Attorney, Agent, or Firm*—Frank A. Lukasik

[57] ABSTRACT

A man's undergarment ergodynamically designed to have the combined quality and characteristics of a brief and an athletic supporter and which is of scant dimensions and fits snugly about a man's body with leg openings of such size as to provide additional comfort to the wearer. The system comprises four major parts, a waistband, a front panel, a back panel, and a 3-dimensional raised insert stitched in an oval shaped cutout in the front panel to act as a cradle and provide support without crush. Elastic edges are provided on the leg openings. Each of the parts are designed so that when sewn together, they provide a perfect fit for each size.

6 Claims, 2 Drawing Sheets

ERGONOMICALLY ENGINEERED UNDERWEAR

BACKGROUND OF THE INVENTION

1. Field of the Invention

This invention relates generally to an undergarment, and more particularly to a man's undergarment having the combined quality and characteristics of a brief and an athletic supporter but designed to provide comfort and support rather than a "compacting" effect of a normal athletic supporter and which is of scant dimensions and fits snugly about a man's body with leg openings of such size as to provide additional comfort to the wearer not found in briefs.

2. Discussion of the Prior Art

An athletic supporter has been and is currently widely used. This type of supporter consists of elastic straps holding a knitted pouch. The pouch has no body and consequently does not maintain a predetermined shape. Moreover, the athletic supporter does not have any covering cloth panels except for the pouch, and obviously does not take the place of a brief, shorts, trunks, or the like. The athletic supporter is usually worn by those engaged in sports for protective purposes, and is not usually worn by man in his everyday activities or pursuits. If one would wear such athletic supporter during normal activities, an additional undergarment such as shorts would also be worn to provide coverage for the buttocks and adjoining body portions.

In addition, it is also understood that the conventional briefs or undergarments of this general type, do not provide the support of the kind attributed to an athletic supporter. These undergarments are made of cloth that sags, pinches, rubs or rides up, and have an inside fly that reduces or precludes any supportive characteristics that might otherwise exist.

One such prior art garment is shown in U.S. Pat. No. 3,499,442 to Steinmetz which discloses a man's supporter brief undergarment that includes an elastic U-shaped pouch strap attached to an elastic waistband, and an elastic panel attached to and located inside the U-shaped strap to provide a shaped, supporting pouch at the front of the garment. A pair of elastic leg straps are attached to the U-shaped strap substantially at the strap bight, and are attached to opposite sides of the U-shaped strap to provide leg openings. A cloth covering is attached to and extends between the waistband, pouch strap and leg straps. Although Steinmetz purports to provide additional room for comfort, the pouch is vertical and would not provide much additional room. In addition, the leg openings would also not be large enough to prevent binding while seated.

U.S. Pat. No. 2,534,024 to Hochbaum, although not directed to a man's undergarment, discloses women's underwear of the type which is of scant dimensions and fits snugly about a person's body and is formed along its sides with leg openings of such size that margins of the leg openings fit closely about upper portions of the legs.

U.S. Pat. No. 4,972,525 to Hwang discloses underpants with smooth side panels free of protruding edges and elastic bands to provide comfort during sleeping on either side to minimize waistband discomfort and render the sides of the underpants inconspicuous when worn under a pair of trousers or skirt. Although Hwang provides large leg openings, it does not provide a pouch for male wear.

All of the above patents are directed to the comfort of the wearer and are attempts to solve the problems associated with wearing undergarments. However, each of the prior art improvements are restricted by their use of conventional shapes and materials. Merely combining the features of an athletic supporter with those of a pair of briefs is insufficient to correct the problems with the prior art undergarments.

SUMMARY OF THE INVENTION

The invention is a personal suspension system which is ergonomically designed for proper fit and proper support. The system comprises four major parts, the insert, the front, the back and the waist band. Each of the various parts are designed so that when sewn together, they provide a perfect fit for each size.

The garment construction eliminates the prior provision of an inside fly in a brief which consists of an opening in the pouch. Instead, the garment provides an "outside fly" that enables ready access to the pouch interior without adversely affecting the supportive quality of the brief, the "outside fly" constituting that portion of an elastic strip in the front panel adjacent to the insert and defining the leg opening. Consequently, the undergarment can be worn by men at all times as during work, leisure or periods of increased physical activity, and the garment will provide the modest covering, holding, moisture absorbing and comfort of a brief and athletic supporter. The garment is lightweight, flexible and snug fitting.

Wearing the underwear of the instant invention permits greater motion in a sitting position without the discomfort of binding. Once the garment is put on and the man's genitals are held by the insert, they are protected away from the body and are less likely to be injured. It has been found that there is no need to adjust the position of the genitals once they have been placed in the insert. Unlike the image of athletes continuously making adjustments on the television screen, adjustments are not required with the instant invention. Any movement of the body is accommodated by the stretch of the elastic and the stretch material of the invention. Many of the improvements of the instant invention would not have been possible when the cited prior art was developed because of the availability of the new stretch fabrics, threads and available sewing techniques.

DESCRIPTION OF THE PREFERRED EMBODIMENT

Figure 2:
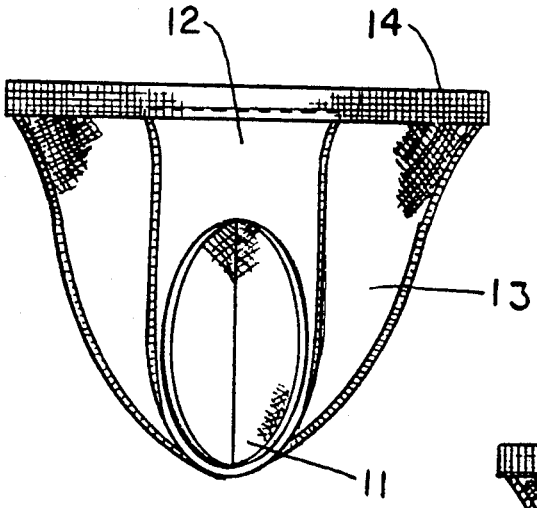
FIG. 2 is a front view of the undergarment of the instant invention.
Figure 3:
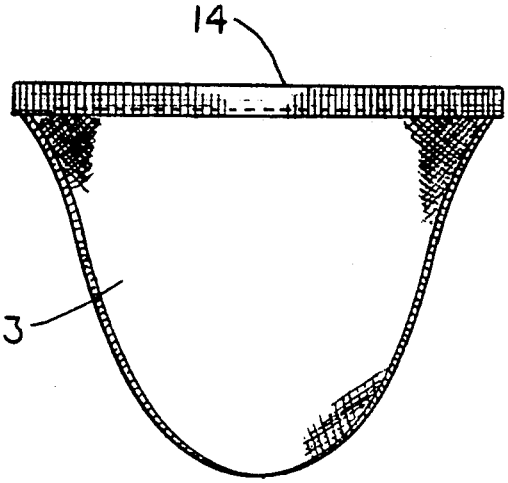
FIG. 3 is a back view of the undergarment of the instant invention.
Figure 1:
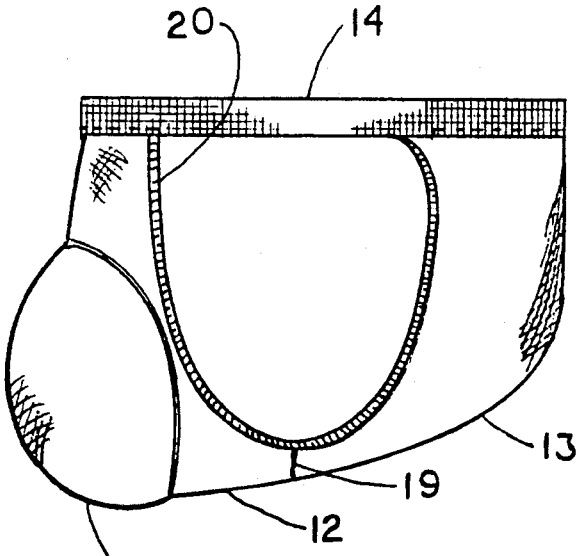
FIG. 1 is a side view of the undergarment of the instant invention.
Figure 4:
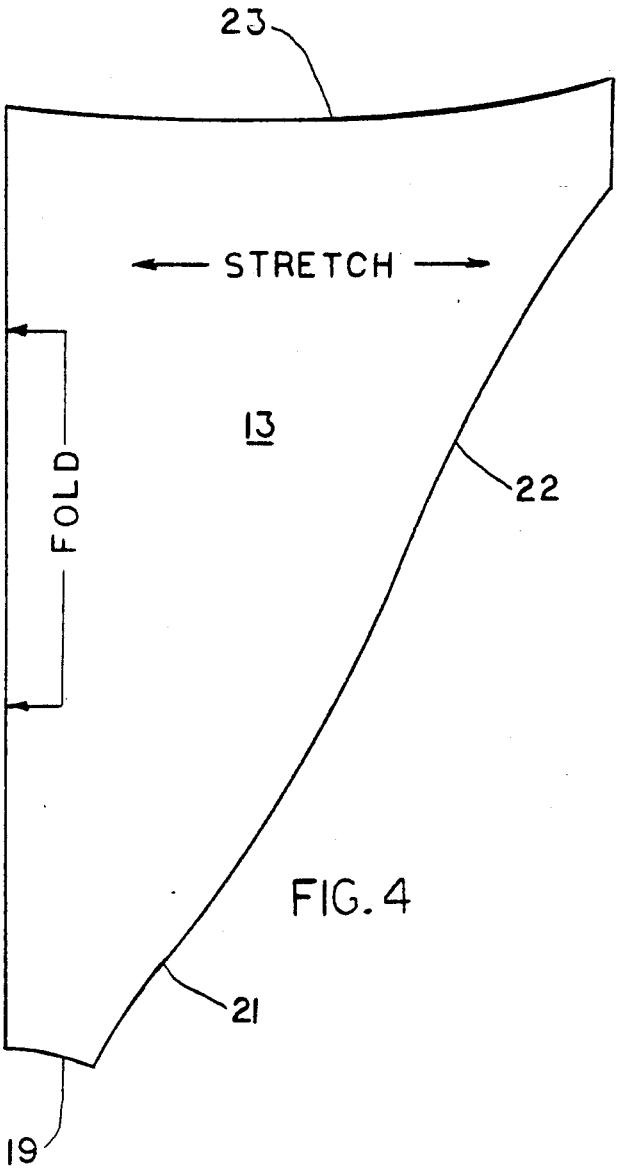
FIG. 4 is a plan view of a back panel.
Figure 5:
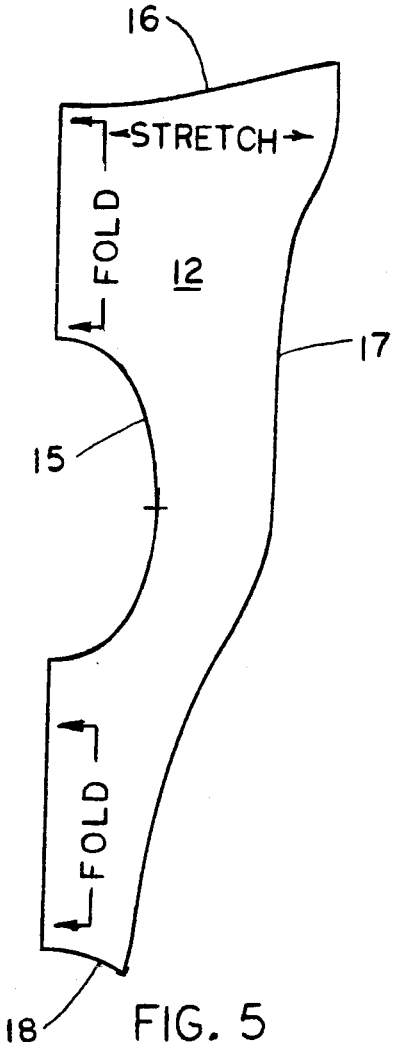
FIG. 5 is a plan view of a front panel.

Referring now to FIGS. 1-3, the undergarment includes an insert 11, front panel 12, back panel 13, and a continuous, endless, waist band 14, adapted to fit around the waist of the wearer. Front panel 12, made of stretch-textured material is attached to the waist band 14. The front panel 12 is cut from a folded blank of material as shown in FIG. 5 and is contoured to precisely fit the anatomy as shown at insert cut 15 and contoured edges 16, 17, and 18. Along the contoured edges 17 of front panel 12, elastic is applied to form the front part of the leg openings 20. Elastic is also applied to the contoured edges 21, 22 of back 13. The elastic edges 17, 21 and 22 of the leg openings 20 are elastic which are stretchable longitudinally and secured at their ends so that they have a tendency to contract and draw the side edge portions of the garment into close fitting engagement with the legs of the person wearing the garment. These elastic bindings also cause the side edges of the crotch portion to be held snugly in place but since the bindings may be stretched longitudinally, it is possible to greatly enlarge the leg openings and draw the crotch portion and the front section towards one side where it will be out of the way when responding to calls of nature (the outside fly).

Bottom contoured edge 19 of back panel 13 is sewn together with edge 18 of front panel 12 to form crotch seam 19. Top contoured edge 23 of back panel 13 is sewed to waist band 14 as shown in FIG. 3.

Figure 6:
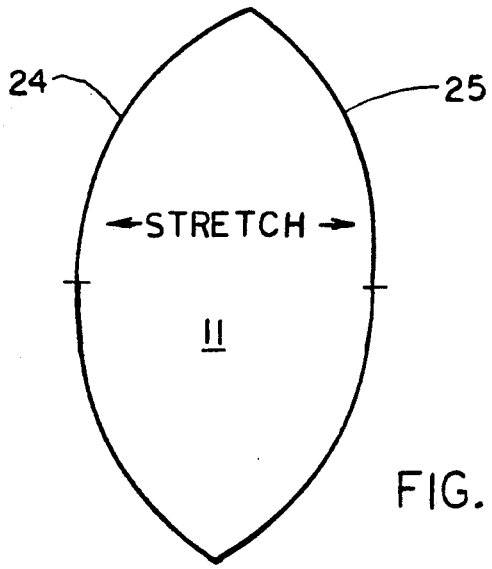
FIG. 6 is a plan view of an insert.

The insert 11 is assembled from four units as shown in FIG. 6. After assembly, the contoured edges 24, and 25 of the insert 11 are sewn into the cutout formed at 15 in front panel 12. Four sections of cutouts are used to form insert 11 to provide the large receiving pouch of the garment, and to provide sufficient material to absorb any mistakes or surplus body liquids. The large pouch created by assembly of the insert provides the room necessary for comfortable underwear. In addition, the fact that the insert protrudes away from the body prevents the pressures normally applied by prior art undergarments which generally are constructed with vertical

CONSTRUCTION INSTRUCTIONS

The following is a list of materials and construction procedures used in manufacturing a preferred embodiment of the invention:

I. Fabric Specifications:
- A. 100% Nylon/Lycra Interlock
- B. 100% Cotton Interlock
- C. 50/50 Cotton/Poly Interlock II. Elastic Specifications:
- A. 1 inch "Bike Elastic", Rhode Island Textile Company
- B. 1.25 inch Men's Underwear elastic, Keel's
- C. ⅜ inch Knit Swimmer elastic, Rhode Island Textile Company III. Thread Specifications:
- A. Metrosene, Switzerland IV. Cutting Procedure:
- A. Fabric Cutting
  1. Front-Cut on fold, with grain, mark center front
  2. Back-Cut on fold, with grain, mark center back
  3. Insert-Cut 4, follow grain lines, mark center seam side (single knit optional for cooler effect)
- B. Elastic Cutting
  1. 1 inch "Bike Elastic"
     - a. Sizes 30–32, cut 28 inches
     - b. Sizes 34–36, cut 30 inches
     - c. Sizes 38–40, ; cut 32 inches
     - d Sizes 42–44, cut 34 inches
  2. 1.25 inch Underwear elastic
     - a. Sizes 30–32, ; cut 29 inches
     - b. Sizes 34–36, cut 31 inches
     - c. Sizes 38–40, cut 33 inches
     - d. Sizes 42–44, cut 35 inches V. Construction Procedures:
- A. Insert
  1. Right sides together, 2 units are joined with a narrow three-thread serger stitch. Stitch thread matched to fabric, overlock neutral. Join second unit.
  2. Baste 2 joined units, wrong sides together, matching seams.
  3. Put insert unit into front with right sides together. Match center front and insert seams. Stitch with 4 thread serger seaming.
  4. Top stitch with a 1/32", 18 stitches-to-the-inch zig-zag.
- B. Crotch Seam
  1. Join crotch seam, right sides together, narrow 3 thread serger stitch.
- C. Sides
  1. Side elastic application
     - a. 4 thread serger stitch, elasticator to create a 2:3 inch ratio stretch applied to wrong side.
     - b. Roll to wrong side, top stitch with a 1/32" zig-zag, 18 stitches per inch.
- D. Waist Band
  1. Join elastic with a satin zig-zag, 3/16" wide.
  2. Attach to top of back and front, matching centers and offsets, right side of elastic to wrong side of garment. Zig-zag 1/16", 18 stitches per inch.
  3. Trim away any excess fabric above elastic edge.
  4. Turn elastic to right side of garment. Top stitch along bottom edge, same stitch as above.
  5. Bar tack edges where waist band meets garment
- E. Label application
  1. Zig-zag 1/16', 18 stitches per inch.
  2. May be glued.

Although the system described in detail above has been found to be most satisfactory and preferred, many variations in mechanics, structure and method are possible. For example, cotton or nylon or other type of stitches may be used, although not as effectively as suggested above.

The above are exemplary of the possible changes or variations because many varying and different embodiments made within the scope of the inventive concept herein taught and because many modifications may be made in the embodiments herein detailed in accordance with the descriptive requirements of law, it should be understood that the details herein are to be interpreted as illustrative and not in a limiting sense.

What is claimed is:

1. A personal suspension system ergonomically sized for proper fit and comfort comprising:

an elastic waistband, a back panel of stretch fabric stitched at a first end said waistband, said back panel having elastic seams formed along opposite side edges extending from said first end to a second end, a front panel of stretch fabric stitched at a first end to said waistband at a position opposite said back panel, and a second end stitched to said second end of said back panel, said front panel having an oval shaped cutout located in a central position, said front panel having elastic seams formed along opposite side edges extending from said first end to said second end, said elastic seams of said front and back panels together forming elastic edged leg openings said leg openings extending from said waist band to said second edges and thereby providing an outside fly, and insert means, forming a double-layered, three-dimensional, raised, receptacle, stitched within said front panel oval shaped cutout for creating a cradle or hammock effect for gently supporting a man's genitals.

2. A personal suspension system as defined in claim 1, wherein said insert means comprises four oval shaped panels, two of said panels being joined together to form a unit, two of said units being basted, wrong sides together, with matching seams.

3. A personal suspension system as defined in claim 2, wherein said insert is stitched with a four thread serger seaming and a 1/32", eighteen stitches-to-the-inch zigzag.

4. A personal suspension system as defined in claim 1, wherein each of said panels comprise 50/50 cotton/-poly interlock, 20% stretch.

5. A personal suspension system as defined in claim 1, wherein each of said panels comprise nylon/lycra interlock, 40% stretch swimwear.

6. A raised, double-layered three-dimensional insert piece, for creating a cradle or hammock effect for gently supporting a man's genitals away from the body, thereby providing a cooler, less binding environment when affixed to a pair of men's briefs or athletic supporter, said insert piece comprising four oval shaped panels, two of said panels being joined to form a unit, two of said units being basted, wrong sides together, with matching seams.

* * * * *